US005173154A

United States Patent [19]

Heinrich

[11] Patent Number: 5,173,154

[45] Date of Patent: Dec. 22, 1992

[54] HEAT SEALABLE TEA BAG PAPER AND PROCESS OF PRODUCING SAME

[75] Inventor: Günter Heinrich, Gernsbach, Fed. Rep. of Germany

[73] Assignee: Unicon Papier und Kanststoffhandel sgesellschaft mbH, Gernsbach, Fed. Rep. of Germany

[21] Appl. No.: 762,725

[22] Filed: Sep. 16, 1991

Related U.S. Application Data

[63] Continuation of Ser. No. 467,669, Jan. 19, 1990.

[30] Foreign Application Priority Data

Jan. 26, 1989 [DE] Fed. Rep. of Germany ..... 3902298

[51] Int. Cl.[5] ..... D21H 13/00

[52] U.S. Cl. ..... 162/129; 162/130; 162/157.5; 162/149; 162/148

[58] Field of Search ..... 162/129, 130, 146, 147, 162/149, 123, 207, 157.5, 157.6; 426/84, 77

[56] References Cited

U.S. PATENT DOCUMENTS

| | | | |
|---|---|---|---|
| 2,414,833 | 1/1947 | Osborne | 162/129 |
| 3,386,834 | 6/1968 | Noiset | 426/84 |
| 4,274,915 | 6/1981 | Munari | 162/129 |

FOREIGN PATENT DOCUMENTS

| | | | |
|---|---|---|---|
| 3159599 | 7/1988 | Japan | 162/148 |
| 572962 | 10/1945 | United Kingdom | 162/146 |

OTHER PUBLICATIONS

Herman, D. F., et al., "Polyethylene Encapsulated Cellulose-A New Papermaking Fiber", Tappi vol. 48, No. 7, pp. 418-423.

*Primary Examiner*—Karen M. Hastings
*Assistant Examiner*—Brenda Lamb
*Attorney, Agent, or Firm*—Fulwider, Patton, Lee & Utecht

[57] ABSTRACT

The tea bag paper comprises a first phase of natural fibers in a weight percentage of from 60% to 85%, and a second phase of heat-sealable synthetic fibers with the remainder of the weight percentage of from 15% to 40%. The second phase penetrates the first phase in such a way that both sides of the paper are adapted to be heat-sealed, with the unit area weight of the paper being between 10 and 15 g/m$^2$. The tea bag paper exhibits enhanced tea diffusion, and may be processed on special high-speed automatic tea packing machines, because it is heat-sealable on either side thereof.

4 Claims, 2 Drawing Sheets

HEAT SEALABLE TEA BAG PAPER AND PROCESS OF PRODUCING SAME

Figure 1A:
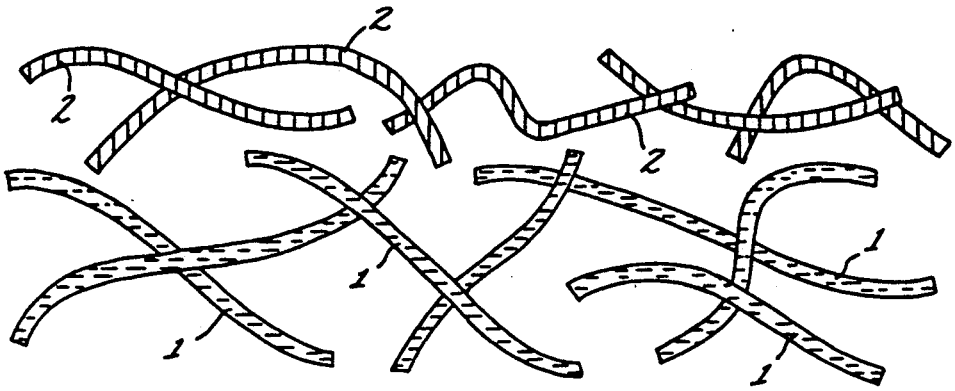

This is a continuation of copending application(s) Ser. No. 07/467,669 filed on Jan. 19, 1990.

The present invention relates to a tea bag paper, comprising a first phase of natural fibers and a second phase of heat-sealing synthetic fibers. Furthermore, the present invention relates to a process of producing such a tea bag paper, and a tea bag made from said paper.

Heat-sealable tea bag papers are known which have a unit area weight of at least 16 g/m$^2$, and which may be processed into tea bags on high-speed automatic packing machines at a rate of up to 4,000 units per minute. Normally, these tea bag papers consist of about 75% of natural fibers and about 25% of heat-sealing synthetic materials.

European patent specification 00 39 686 describes a multi-phase heat-sealing fibrous material and the process of producing same. In this multi-phase material, portions of a high tea diffusion and such of a low tea diffusion are provided alternately. This is obtained in that the portions of high tea diffusion have a substantially smaller proportion (percentage) of heat-sealing fibers than the portions of lower diffusion. Apart from the complex process described in said publication, the weight of the tea bag is relatively high with 16.5 g/m$^2$. Further, owing to the irregular distribution of the heat-sealing fibers for defining portions of high and low diffusion, there is the risk that upon sealing of the tea bag, its seams are less resistant in boiling water than the seams of a bag which has been formed from a paper having a continuously uniform heat-sealing layer.

German patent specification 2,147,322 describes the production of a heat-sealable paper having a weight of between 14 to 17 g/m$^2$, and in which the heat-sealable fibers or particles are concentrated preferably to one side of the paper surface. However, if the heat-sealable layer is provided preferably on one side of the paper only, and this layer is then fused during the drying process on the paper-making machine, this-layer closes or blocks the porous base layer, thereby preventing good diffusion of tea.

German patent specification 1,546,330 describes a process in which the thermoplastic fibers and the non heat sealable fibers are deposited in common in an aqueous suspension on the wire of a papermaking machine. Owing to the characteristic of the lower density of the thermoplastic fibers formed of polypropylene, a different proportion of polypropylene fibers is deposited or precipitated on the opposite surfaces of the paper formed. Accordingly, the drawbacks mentioned above with respect to one-sidedly sealable papers similarly apply to this process. Described is this process for a paper of a weight of 17 g/m$^2$.

Moreover, there are known heat-sealable tea bag papers having a so-called open structure in which openings of various sizes and shapes are formed in the paper by various methods. This structure is intended to provide improved tea diffusion, which is not readily obtained, however. At any rate, this open structure of the paper greatly limits the use of the tea bag paper, as an excessive amount of dust-like material would pass through the paper. All of these so-called open papers are being produced in a weight class of above 16 g/m$^2$.

A feature common to all of these conventional heat-sealable tea bag papers is that these papers, due to their relatively high unit area weight and the high proportion or content of synthetic fibers, show a tea diffusion inferior to that of the conventional light-weight, not heat-sealable materials having a weight of about 12 g/m$^2$. However, these conventional tea bag papers, consisting of a single phase, can be processed on packing machines only with a relatively complex folding process, and only at a rate per unit of time of about 230 bags/minute.

It is the object of the present invention to provide a light-weight heat-sealable tea bag paper which has a substantially enhanced tea diffusion compared to conventional heat-sealable papers, and which may be processed on high-speed tea bag producing machines calling particularly for double-sided sealing of the paper. Further, the invention contemplates to provide a process for the production of such a tea bag paper.

According to the present invention, this object is solved by a tea bag paper in which the first phase of a weight percentage of from 60 to 85% is penetrated by the second phase having the remainder of the weight percentage of from 15 to 40%, in such a way that both sides of the paper are heat-sealable, with the weight per unit area of the paper being between 10 and 15 g/m$^2$, preferably 12 g/m$^2$. According to a preferred embodiment, the first phase comprises natural fibers having a weight per unit area of from 8.5 to 9.7 g/m$^2$, and the second phase comprises synthetic fibers having a weight per unit area of from 3.1 to 4.0 g/m$^2$.

Regarding the process of production, the object of the invention is solved in that in one step an aqueous suspension of the natural fibers having a stock density of less than 0.1% is deposited on the wire (or screen) of a papermaking machine to form a first layer; that in a second step the heat-sealable synthetic fibers are deposited from an aqueous suspension onto the first layer in a way to penetrate the first layer; and that the tea bag paper is obtained from said two layers by dewatering and drying in accordance with conventional methods. Here, the penetration of the two layers can be particularly intensified by rigorous dewatering.

Well-known natural fibers, such as hemp, Manila hemp, jute, sisal and others, as well as long-fiber wood pulp may be used for the first layer. Preferred materials for the second layer of heat-sealable fibers are polyethylene, polypropylene or copolymers of vinyl chloride and vinyl acetate.

In the production operation, the synthetic heat-sealing fibers of the second phase penetrate the first phase, to enclose or cover the natural fibers in a molten state during the drying process on the papermaking machine. These fibers thereby expose the necessary pores in the material. Thus, tea diffusion is not impaired in the material according to the invention. Furthermore, the material according to the invention can be heat-sealed on both sides, and this feature is likewise ensured by the penetration of the second phase through the not heat-sealing first phase.

Figure 1B:
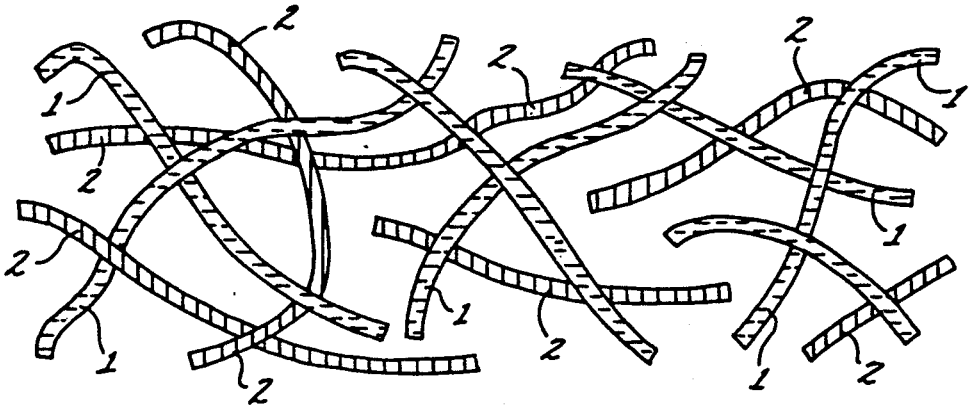
Figure 1C:
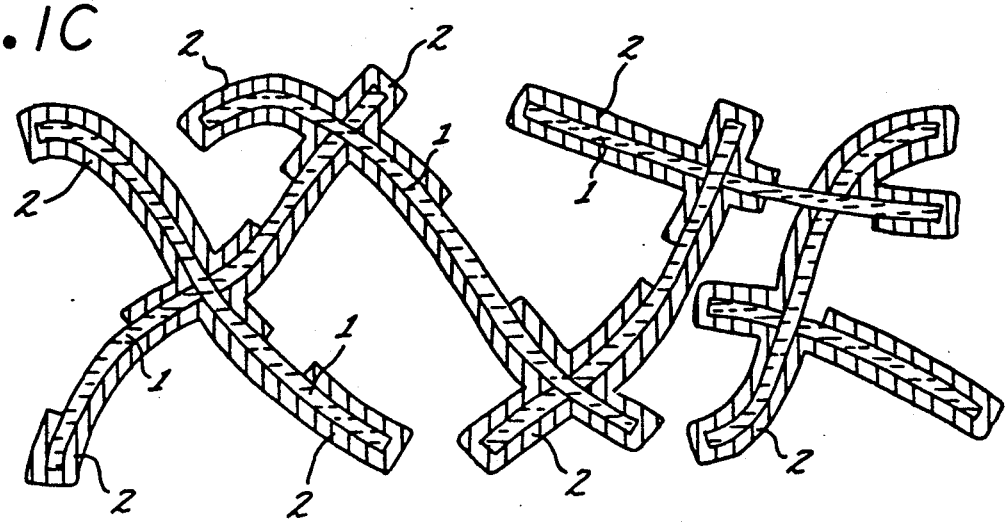
Figure 2:
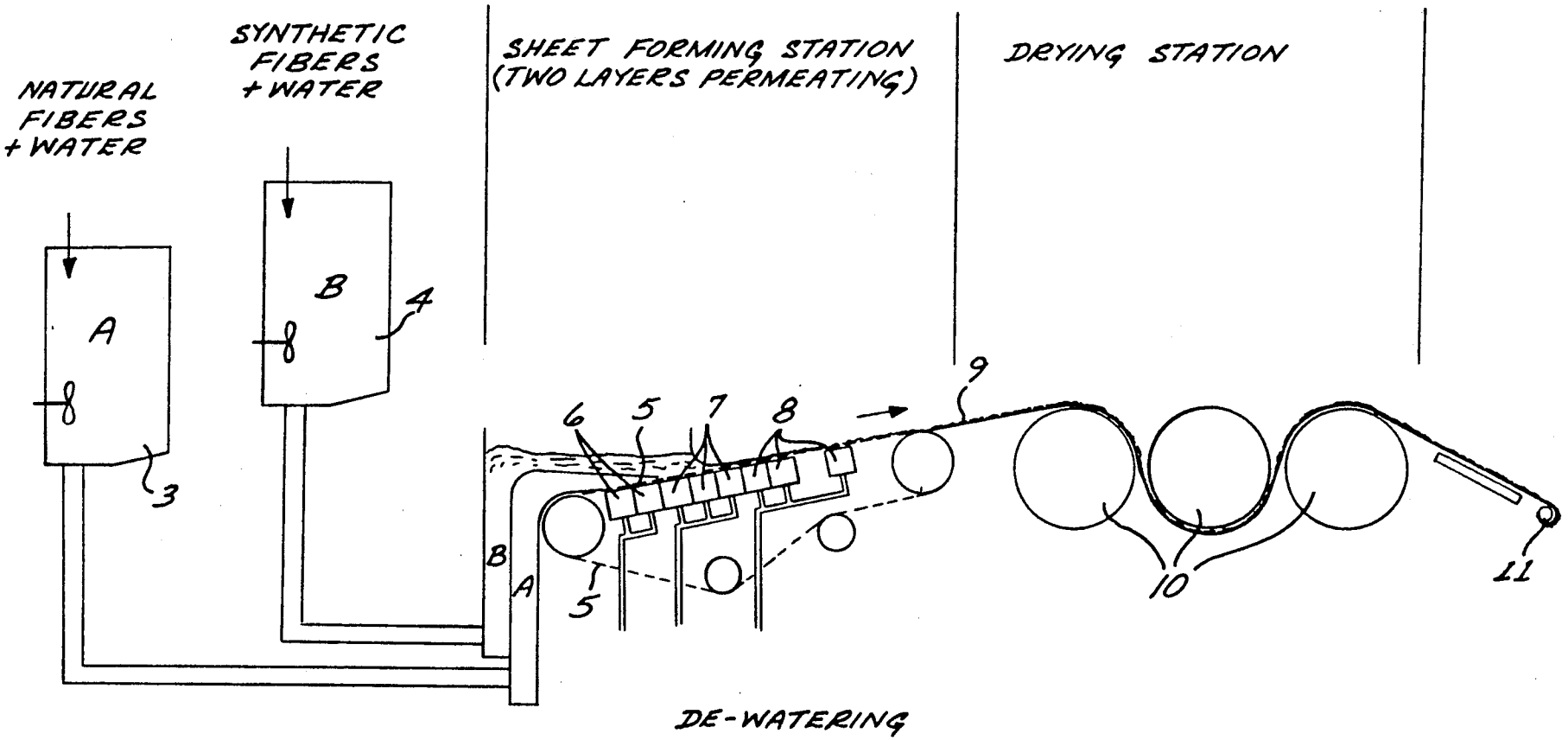

Below, the invention is described in greater detail in an exemplary embodiment with reference to the drawings, wherein:

FIG. 1*a* through 1*c* is a general, roughly schematical illustration of the various steps in the formation of the tea bag paper according to the invention from natural fibers and synthetic fibers; and FIG. 2 illustrates, likewise in a roughly schematical form, the structure of a system for carrying out the process according to the invention.

FIG. 1 shows in schematical illustration the formation of the tea bag paper according to the invention. FIG. 1*a*) illustrates the formation of a first fibrous layer of natural fibers 1, and the formation of a second fibrous layer of synthetic, heat-sealable fibers 2. As shown, the second layer containing the fibers 2 is formed by depositing this layer above the second layer formed of the natural fibers 1. In the drawing, for distinction the natural fibers 1 are hatched horizontally, while the synthetic fibers 2 are hatched approximately vertically.

FIG. 1*b*) shows how penetration of the two layers is obtained by the above-mentioned rigorous dewatering of the two layers, especially of the second layer containing the fibers 2, such that the synthetic fibers 2 come to lie between the natural fibers 1, to extend between the natural fibers 1 from the upper side of the first layer to the bottom side thereof.

In a further production step, the layers 1 and 2 penetrating each other are dried and thereby heated in such a manner that the synthetic fibers 2 melt and, upon solidification, wrap around the fibers 1 so that these fibers are enclosed or covered at least partially. In this way, the final tea bag paper becomes heat-sealable on both sides thereof (FIG. 1*c*)).

FIG. 2 illustrates the basic structure of a papermaking machine which may be used for producing a tea bag paper according to the invention. First, a suspension "A" is prepared from ground natural fibers and water, and another suspension "B" is prepared from the partially ground Synthetic fibers and water. These two suspensions A and B are supplied from the respective reservoirs 3 and 4 to the papermaking machine through the so-called head box (or breast box). The papermaking machine comprises essentially a rotating wire (screen) 5 which travels across a plurality of dewatering chambers 6, 7 and 8.

Through suitable pipelines and pump devices (not illustrated), suspension A is deposited on wire 5 above the first two dewatering chambers 6, and water is sucked off through chambers 6 and a dewatering pipe a. In this way, a first fibrous layer of natural fibers 1 is formed on the moving wire 5. When the wire 5 is advanced to a position above the dewatering chambers 7, the second suspension B is supplied, thereby to deposit a second layer of synthetic fibers onto the first layer above the dewatering chambers 7. In this stage, dewatering takes place through dewatering pipe b. Upon further movement of the wire 5 supporting the two superposed fibrous layers, rigorous dewatering is effected above dewatering chambers 8, whereby the two layers are caused to penetrate each other. By correspondingly controlling the dewatering effect, a higher or lesser degree of penetration may be obtained.

The thus formed material 9 of natural fibers and synthetic fibers is removed from the wire and transferred to a drying stage. Such drying may be effected in various ways. For example, by contact drying or flow-through drying. Corresponding drying elements are indicated in a roughly schematical way by elements 10. FIG. 2 (drying station) illustrates three drying cylinders 10 through which the paper web formed is dried by the contact method. However, it is also practicable to cause the paper web formed to travel across one single cylinder, and dry it by hot air, without the web contacting this cylinder. Heating of the dual-layer fibrous material results in melting or fusing of the synthetic fibers 2 contained in the compound layer 9. In solidification at the outlet end of the drying station, the synthetic fibers enclose or cover the natural fibers at least partially, such that tea bag paper wound onto a reel 11 is heat-sealable on either side thereof.

The improved characteristics or properties of the tea bag paper according to the invention may be demonstrated below in an Example in comparison with conventional materials. A tea bag paper (sample A) according to the invention was compared with a conventional heat-sealable tea bag paper (sample B) and a conventional, not heat-sealable tea bag paper (sample C). The below characteristics were determined for these three materials:

TABLE

| | A | B | C |
|---|---|---|---|
| Unit area weight ($g/m^2$) | 12.2 | 16.5 | 12.3 |
| Time of initial development of color (seconds) | 8.9 | 11.8 | 9.7 |
| Tea diffusion factor (or product) (density × air resistance) | 1.71 | 3.59 | 1.86 |

Sample A is according to the invention;
Sample B is a conventional heat-sealable tea bag paper;
Sample C is a not heat-sealable tea bag paper.

Explanations with respect to the Table:

Time of initial development of color

Tea bags of precisely the same configuration were formed from the different papers according to Sample A, Sample B and Sample C, which bags were filled with precisely the same quantity of normal tea. The quantity was about 5 g/bag. Upon immersion of the separate tea bags into boiling water, the period of time was determined until the first or initial color streaks appeared. This period of time is a measure of how fast the flavor-giving and coloring constituents of the tea are extracted from the tea bags made of the different materials.

Tea diffusion factor (product)

Whereas the above-mentioned period of time for the initial development of color is determined in an experimental method, the tea diffusion factor is a mathematical value. Minimum raw density and high porosity (low air resistance) define the rate at which tea extraction from a bag takes place. Accordingly, when the product of raw density and air resistance is as small as possible, the prior conditions for good tea extraction or tea diffusion exist.

The raw density is the well-known quotient of unit area weight and thickness. Air resistance is specified in seconds and determined by measuring the period of time in which a given volume of air flows through a defined surface area of the paper to be tested (compare also Gurley measurement).

As is clear from the above Table, both the time of initial development of color (coloration) and the tea diffusion factor are optimum with Sample A, i.e. the material according to the invention. Accordingly, this material shows a tea diffusion being as good as that of the conventional not heat-sealable papers, or being even slightly better than the tea diffusion of these latter papers; however, the material of the invention may be processed on special high-speed automatic tea packing machines.

I claim:

1. A process of producing a tea bag paper, comprising the steps of:

depositing an aqueous suspension of natural fibers having a stock density of less than 0.1% on a paper machinewire or screen in order to form a first layer, the first layer having first and second sides and forming 60–85 weight % of the tea bag paper;

depositing a second layer comprising heat-sealing thermoplastic synthetic fibers forming 15–40 weight % of the tea bag paper on the first side of the first layer;

dewatering the first and second layers so that said layers merge together and said second layer penetrates said first layer to the extent that said synthetic fibers exist on both first and second sides of said first layer;

melting said synthetic fibers in a subsequent drying process and reconsolidating said synthetic fibers in such a way that they cover said natural fibers when being reconsolidated;

whereby said tea bag paper is heat-sealing on both sides and the weight of said tea bag paper is between 10 and 15 g/m$^2$.

2. A process according to claim 1, wherein said permeation of said first and second layers is intensified by a rigorous dewatering.

3. The process of claim 1, further comprising the step of forming said tea bag paper into a tea bag.

4. The process of claim 1 wherein said heat-sealing thermoplastic synthetic fibers comprise polyethylene, polypropylene, or a copolymer of vinyl chloride and vinyl acetate.

* * * * *